US006553590B1

(12) United States Patent
Leach

(10) Patent No.: US 6,553,590 B1
(45) Date of Patent: Apr. 29, 2003

(54) INFANT SUPPORT PILLOW WITH BODY WRAP

(76) Inventor: Jamie S. Leach, P.O. Box 717, Ada, OK (US) 74820

( * ) Notice: Subject to any disclaimer, the term of this patent is extended or adjusted under 35 U.S.C. 154(b) by 0 days.

(21) Appl. No.: 10/166,912

(22) Filed: Jun. 11, 2002

(51) Int. Cl.[7] ..... A47G 9/00
(52) U.S. Cl. ..... 5/655; 5/922
(58) Field of Search ..... 5/655, 485, 490, 5/494, 436, 437, 922; 128/872, 869

(56) References Cited

U.S. PATENT DOCUMENTS

| | | | | |
|---|---|---|---|---|
| 2,404,505 | A | 7/1946 | Knecht | |
| 4,227,270 | A | 10/1980 | Rivera | 5/655 |
| 4,861,109 | A | 8/1989 | Leach | 297/467 |
| 4,871,210 | A | 10/1989 | Alexander et al. | 297/435 |
| D313,141 | S | 12/1990 | Witter, et al. | D6/601 |
| 5,048,136 | A | 9/1991 | Popitz | |
| 5,178,309 | A | 1/1993 | Bicheler et al. | 224/153 |
| 5,439,008 | A | 8/1995 | Bowman | 5/655 |
| 5,546,620 | A | 8/1996 | Matthews | 5/655 |
| 5,551,109 | A | 9/1996 | Tingley et al. | 5/655 |
| 5,826,287 | A | 10/1998 | Tandrup | 5/655 |
| 6,205,600 | B1 | 3/2001 | Sedlack | 5/655 |

*Primary Examiner*—Alexander Grosz
(74) *Attorney, Agent, or Firm*—William S. Dorman

(57) ABSTRACT

An infant support pillow having an outer concentric curved periphery and an inner curved boundary, the inner curved boundary being provided with a fabric body wrap comprising a T-shaped member having a fabric leg extending longitudinally therefrom and having transversely extending straps attached at right angles thereto, the fabric leg being adjustable in length and the transversely extending straps being attachable in various positions to an underside of the support pillow to form a seat in which an infant can be placed, the dimensions of which seat may be adjusted to accommodate infants of various sizes, the outer concentric curved periphery and inner curved boundary forming a pair of interconnected curved arms which are adjustable inwardly and outwardly with relation to a central circular opening formed by the inner curved boundary to permit the diameter of the central circular opening to increase or decrease, thereby causing the body of an infant to be elevated in a reclining position or, alternatively, causing the body of an infant to sink into the central circular opening to permit the infant to be held in an upright or sitting position, and the inner curved boundary being further provided with a pocket into which the fabric body wrap may be folded and hidden when not in use.

6 Claims, 3 Drawing Sheets

INFANT SUPPORT PILLOW WITH BODY WRAP

BACKGROUND OF THE INVENTION

1. Field of the Invention

The present invention relates to an infant support pillow. More particularly, the present invention relates to an infant support pillow having a T-shaped fabric belt consisting of an adjustable longitudinally extending fabric leg with transversely extending straps which can adjustably wrap around the arms of the support pillow and attach at an underside thereof to form a seat for an infant. The arms of the support pillow may be pulled inwardly or outwardly and secured with the T-shaped fabric belt to fit snugly against the body of an infant and elevate the infant in a reclining position or, alternatively, to form a well in which an infant may be held in an upright or sitting position. The pillow is provided with a pocket on an underside thereof into which the T-shaped fabric belt can be tucked away when not in use.

2. The Prior Art

There are a number of patents that show or relate to infant support pillows. Some support pillows are designed particularly for infants, and some can accommodate adults or older children in addition to infants. It is believed to be novel to provide an infant support pillow with an attached body wrap comprising a T-shaped belt having a longitudinally extending fabric leg attaching at a first end to the support pillow and attaching at a second end to transversely extending straps to secure an infant within the central circular opening of the support pillow. A preliminary patentability search was conducted on this invention and the following listed references were uncovered in the search:

| Inventor | Pat. No. | Date |
|---|---|---|
| Tandrup | 5,826,287 | Oct. 27, 1998 |
| Bowman | 5,439,008 | Aug. 8, 1995 |
| Alexander, et al. | 4,871,210 | Oct. 3, 1989 |
| Leach | 4,861,109 | Aug. 29, 1989 |
| Witter, et al. | Des 313,141 | Dec. 25, 1990 |
| Knecht | 2,404,505 | July 23, 1946 |
| Sedlack | 6,205,600 B1 | Mar. 27, 2001 |
| Tingley, et al. | 5,551,109 | Sep. 3, 1996 |
| Rivera | 4,227,270 | Oct. 4, 1980 |
| Popitz | 5,048,136 | Sep. 17, 1991 |
| Bicheler, et al. | 5,187,309 | Jan. 12, 1993 |
| Matthews | 5,546,620 | Aug. 20, 1996 |

The above patents are not considered to be particularly pertinent to the present invention. Tandrup U.S. Pat. No. 5,826,287 shows an infant support cushion with crotch and waist encircling Velcro closures. However, the Tandrup patent comprises a modular system consisting of a plurality of connectable cushions designed for use in combination with a seat.

Bowman U.S. Pat. No. 5,439,008 shows an infant support cushion with a diaper-type Velcro restraint. However, the Bowman patent comprises a number of detachable pieces which can be used in various combinations by attachment to a wedge-shaped support member provided with Velcro strips to support an infant in a reclining position.

Alexander, et al, U.S. Pat. No. 4,871,210 shows a booster seat with a harness apparatus attachable thereon to secure a young child in a chair.

Leach U.S. Pat. No. 4,861,109 shows a harness apparatus for securing a young child in a chair.

Witter, et al., Design U.S. Pat. No. 313,141 shows a tooth pillow having a centrally located pocket into which a child's tooth can be deposited in anticipation of a visit from the "Tooth Fairy." The pillow has a U-shape which appears to mimic the shape of a molar.

Knecht U.S. Pat. No. 2,404,505 shows an upright cushion pad having a flexible crotch band and elongated tapes which meet and can be tied at the back portion of the upright cushion pad.

SUMMARY OF THE INVENTION

The present invention comprises an infant support pillow having interconnected curved arms terminating in rounded ends which are spaced apart from each other to form generally a horse-shoe shaped member. The support pillow has an inner curved opening into the center of which an infant may be placed in an upright or semi-upright position. The support pillow is provided with a fabric body wrap comprising a T-shaped belt which attaches at a first end to a central location within the curved opening in the support pillow and which attaches at a second end to transversely extending straps. The ends of the transversely extending straps are provided with one half of a hook and loop fastener, and the underside of the arms of the support pillow are provided with one half of a loop fastener which corresponds to the hook and loop fastener located on the straps. The fabric leg of the body wrap is provided with two pairs of adhesive strips of hook and loop fastener attached longitudinally along the fabric leg, which upper and lower pairs of hook and loop fastener respectively correspond to one another to permit the fabric leg to be shortened in length by folding the fabric leg onto itself such that the hook and loop fasteners come into contact in a number of variable positions to accommodate a premature infant and to permit lengthening of the fabric leg as the infant grows. When the body wrap is employed, the fabric leg can pass between the legs of an infant and the transversely extending straps of the body wrap can pass across the chest and beneath the arms of an infant and continue across the arms of the support pillow, attaching at an underside thereof in a number of variable positions. The arms of the support pillow are adjustable inwardly and outwardly in relation to the inner circular opening of the support pillow, whereby the diameter of the inner circular opening may be increased or decreased to fit snugly against the body of an infant, to elevate the infant in a reclining position, or to form a well into which the body of the infant may be placed in an upright or sitting position. When the transversely extending straps pass across the arms of the support pillow and attach at an underside thereof, the arms of the support pillow are secured in the desired position. The outer curved periphery of the support pillow is provided with peripheral recessed portions over which the transversely extending straps pass and are secured at an underside of the arms of the support pillow. These recessed portions permit the straps to be held securely in place and prevent slipping of the straps along the curved arms of the support pillow. The support pillow is further provided with a pocket located centrally along the inner curved boundary thereof into which the fabric body wrap can be folded and hidden from view when the fabric body wrap is not in use.

DETAILED DESCRIPTION OF THE PREFERRED EMBODIMENTS

Figure 1:
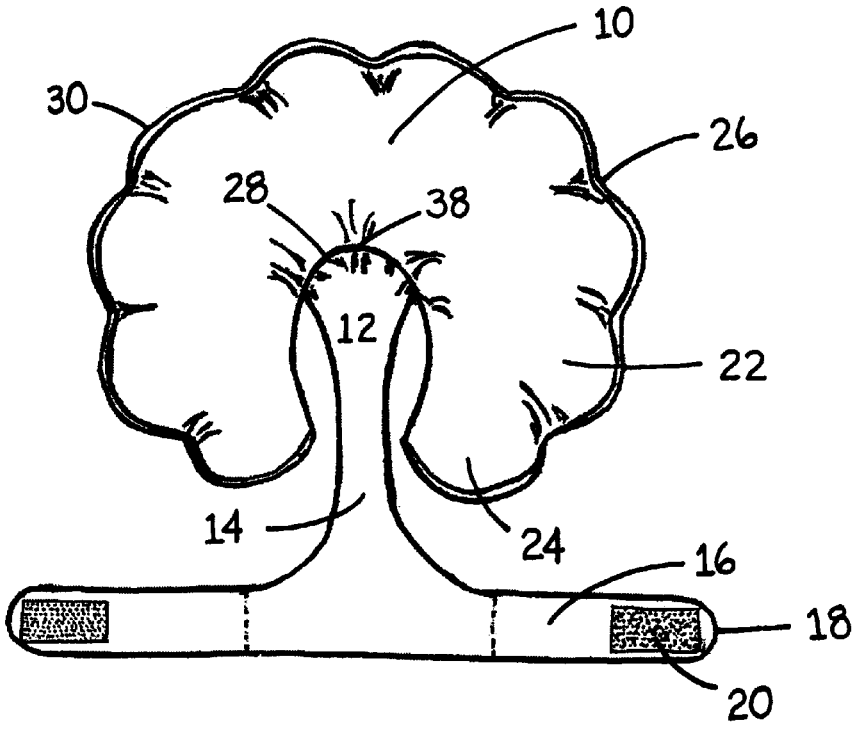
FIG. 1 is a top view of the support pillow showing the longitudinally attached T-shaped member with transversely extending straps in a fully extended position.
Figure 2:
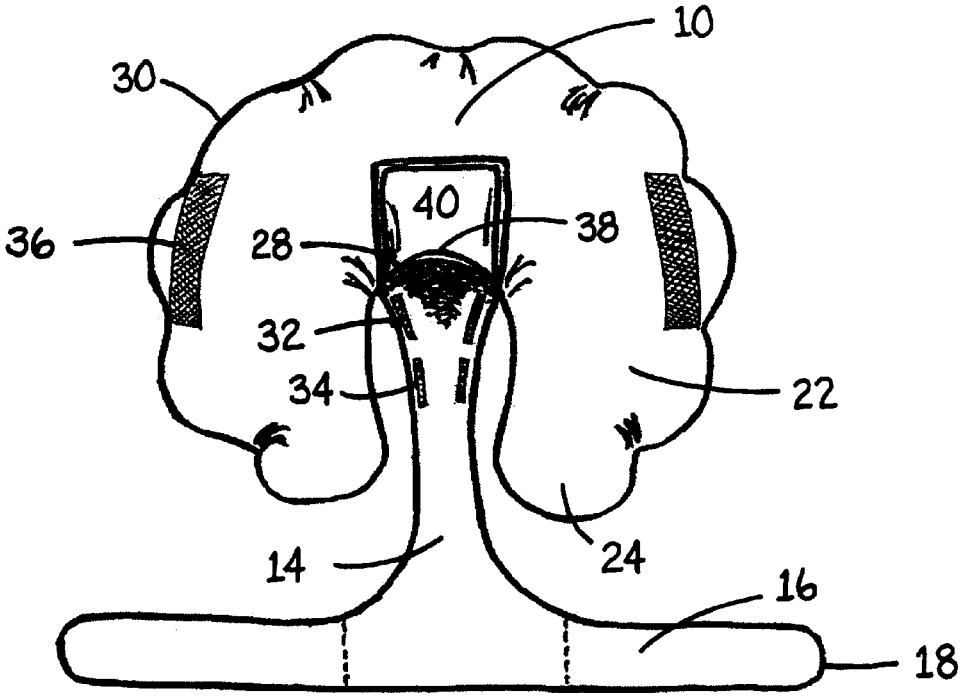
FIG. 2 is a bottom view of the support pillow similar to FIG. 1, but showing the underside of the support pillow having a pocket provided at a central location and a means for adjusting the length of the longitudinally attached T-shaped member.
Figure 4:
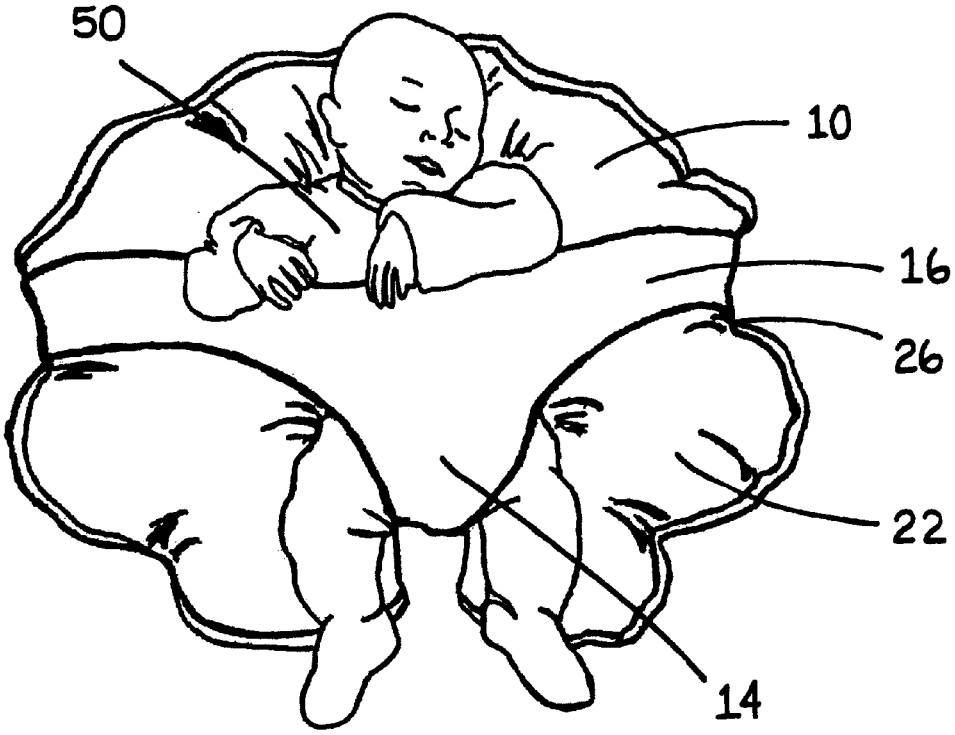
FIG. 4 is a plan view of the support pillow showing the pillow employed in the use of supporting an infant by means of the seat formed by passing the longitudinally attached T-shaped member through the legs of the infant and extending the straps transversely across the body of the infant and attaching the ends of each strap to an underside of the pillow.

Referring to the drawings in detail, FIG. 1 shows a support pillow 10 comprising interconnected curved arms 22 terminating in rounded ends 24 which are spaced apart from each other to form a generally horseshoe-shaped member, the support pillow 10 being provided with an outer concentric curved periphery 30 and an inner curved boundary 28 constituting a inner curved opening and having arms 22 which terminate at curved ends 24. The support pillow 10 may be of any thickness suitable for supporting the body of an infant, but is preferably of a thickness of seven to ten inches. Attached to the inner curved boundary 28 at a central location 38 is a fabric body wrap 12 consisting of a T-shaped belt having a longitudinally extending fabric leg 14 which attaches to a pair of transversely extending straps 16 at right angles thereto. The end 18 of each transversely extending strap 16 is provided with a longitudinally attached adhesive tab 20 comprising one half of a hook and loop fastener for attachment to an underside of the arm 22 of the support pillow, which be discussed below. Each adhesive tab 20 has a preferred length of approximately four to six inches, allowing for maximum adjustability when the adhesive tabs 20 are brought into contact with the corresponding adhesive strips 36 (as shown in FIG. 2). The adhesive tabs 20 located at the ends 18 of the transversely extending straps 16 contact corresponding adhesive strips 36 (as shown in FIG. 2) located along the underside of the arm 22 of the support pillow 10 for the purpose of securing the transversely extending strap 16 in position to hold an infant (as shown in FIG. 4). The outer concentric curved periphery 30 of the support pillow is provided with a series of peripheral recessed portions 26 which prevent slipping of the transversely extending straps 16 when the ends 18 of the straps 16 are attached to an underside of the arm 22 of the support pillow in the manner set forth above. The transversely extending straps 16 may be of any length suitable to accommodate the body of an infant, but preferably have a length of thirty-four inches.

FIG. 2 shows the underside of the support pillow 10 and the corresponding underside of the fabric leg 14 and transversely extending straps 16 of the body wrap 12. The fabric leg 14 is attached at a central location 38 on the inner curved boundary 28 as shown in FIG. 1. The fabric leg 14 is provided with adhesive strips 32 and 34 where each strip 32 is comprised of one half of a hook and loop fastener which corresponds to a cooperating strip 34 which is comprised of the other half of a hook and loop fastener. The corresponding strips 32 and 34, when brought into contact with one another, can be used to adjust the length of the fabric leg 14 and, consequently, the length of the body wrap 12 to accommodate variously sized infants, including premature infants, and can be extended as the infant grows. The fabric leg 14 may be of any length suitable to accommodate the body of an infant, but is preferably of a maximum length of twenty inches when the cooperating adhesive strips 32 and 34 are not employed. As mentioned above, the underside of each arm 22 of the support pillow 10 is provided with an adhesive strip 36 which is attached longitudinally, or substantially parallel to the outer concentric curved periphery 30 of the support pillow 10, each adhesive strip 36 comprising the second half of the hook and loop fastener of the adhesive tabs 20 set forth in FIG. 1. Each adhesive strip 36 is preferably of a length of six to eight inches. The placement of the adhesive strips 36 in substantially parallel relation to the outer concentric curved periphery 30 of the support pillow provides for maximum adjustability when contacting the corresponding adhesive tabs 20 (as shown in FIG. 1) to the adhesive strips 36. The arms 22 of the support pillow 10 can be adjusted to move inwardly or outwardly with relation to the central circular opening (also referred to as an inner curved boundary) 28 such that the central circular opening 28 either increases or decreases in diameter to facilitate adjustment of the tightness of the body wrap 12 to elevate the body of an infant 50 (see FIG. 4) in a number of variable reclining positions or to permit the body of an infant to be held in an upright or sitting position within the central circular opening 28 with the arms 22 of the support pillow 10 fitted snugly against the torso of the infant 50 (see FIG. 4). The underside of the support pillow is further provided with a pocket 40 into which the fabric body wrap 12 can be folded and hidden from view when the fabric body wrap 12 is not needed. The pocket 40 may be of any size suitable to accommodate the fabric body wrap 12 in a folded position.

Figure 3:
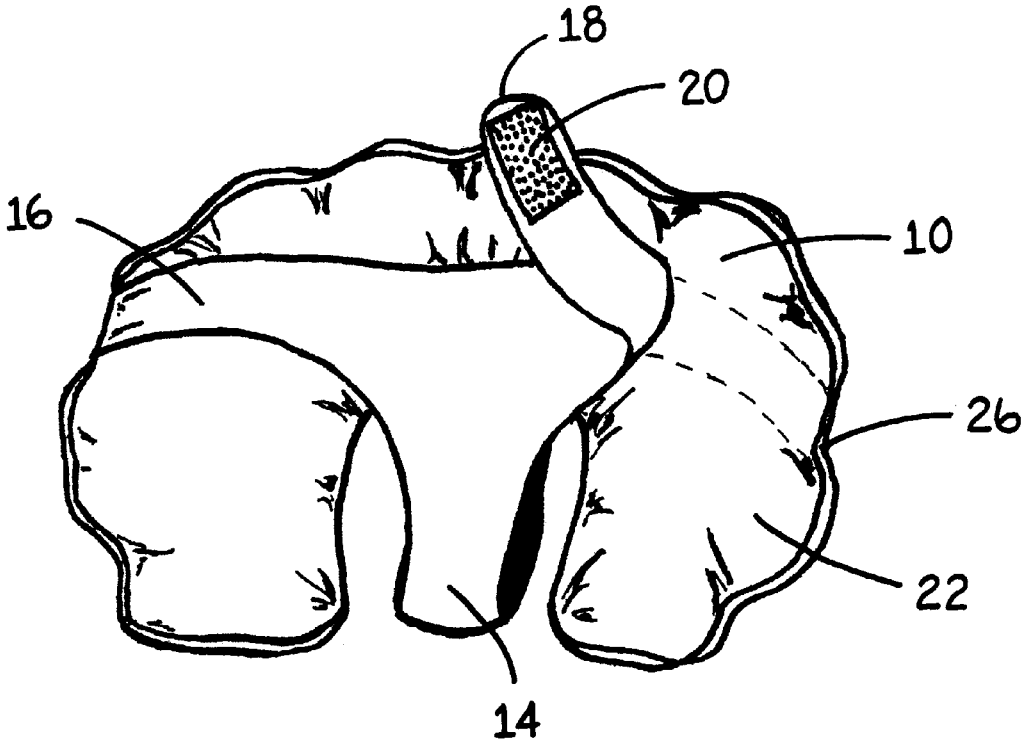
FIG. 3 is a plan view of the support pillow showing the seat as formed by attachment of the transversely extending straps of the T-shaped member to an underside of the support pillow.

FIG. 3 shows a plan view of the support pillow 10 with the fabric leg 14 of the body wrap 12 folded longitudinally and the transversely extending straps 16 are outspread across the arm 22 of the support pillow. One end 18 of the transversely extending straps 16 is wrapped around the arm 22 of the support pillow 10 at a peripheral recessed portion 26 therein and affixed by contacting the adhesive tab 20 comprising one half of a hook and loop fastener with the corresponding adhesive strip 36 (not shown in this view) comprising a cooperating half of a hook and loop fastener attached to the underside of the arm 22 of the support pillow 10.

FIG. 4 is essentially the same view shown in FIG. 3, but showing the support pillow 10 employed in supporting an infant 50. The fabric leg 14 passes through the legs of the infant 50 and covers the body of the infant 50. The transversely extending straps 16 extend across the arms 22 of the support pillow 10 and wrap around the arms 22 at a peripheral recessed portion 26 for attachment to the underside of the support pillow in the manner described above.

Figure 5:
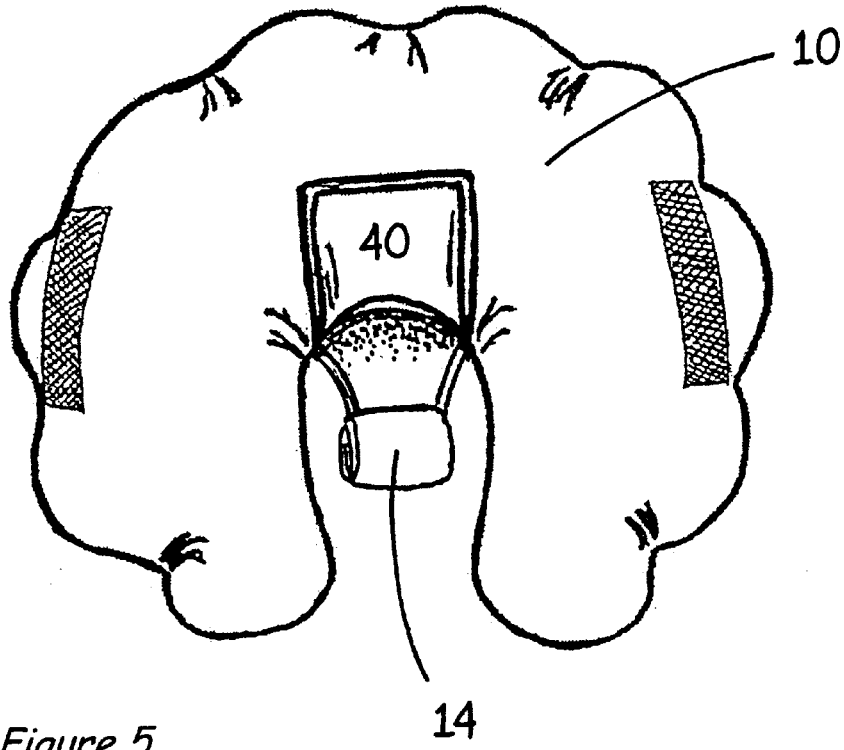
FIG. 5 is a bottom view of the support pillow showing the T-shaped member rolled up in position to be tucked into a pocket provided in a central location on the underside of the support pillow.

FIG. 5 is a bottom view of the support pillow 10 showing the fabric body wrap 12 rolled up in position to be tucked into the pocket 40 provided in the support pillow 10.

Figure 6:
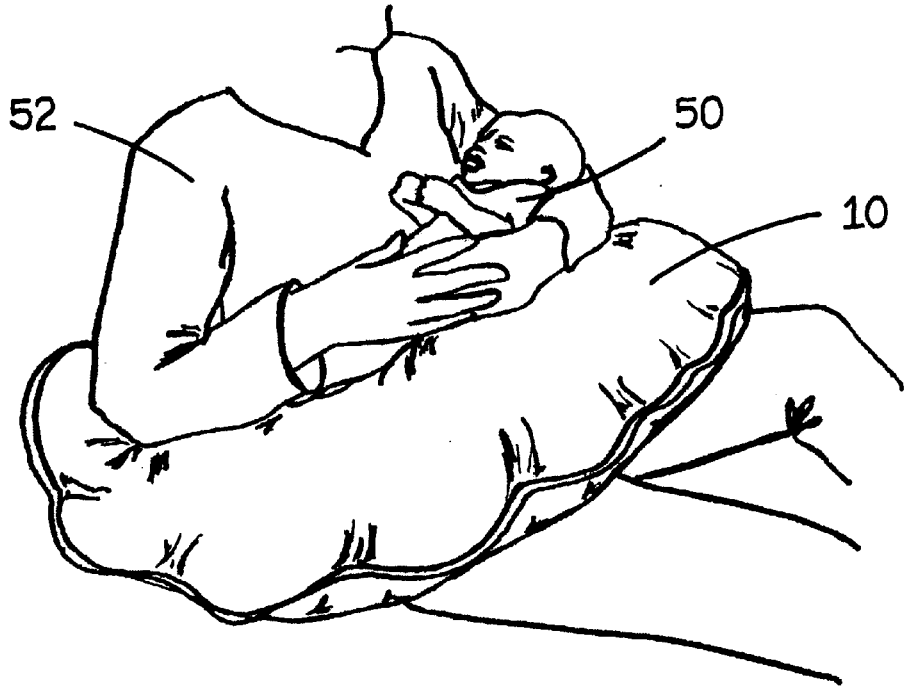
FIG. 6 is a plan view showing an alternate use for the support pillow when the T-shaped member is not in use, whereby the pillow can wrap around the torso of a person to support an infant lying thereon without employing the seat feature of the support pillow.

FIG. 6 is a plan view of the support pillow 10 showing an alternate use for the support pillow when the fabric body wrap 12 (not shown in this view) is tucked away in the pocket 40 (not shown in this view). When the fabric body wrap 12 is not employed, but is rather tucked away in the pocket 40 of the support pillow 10, the support pillow can fit around the torso of an adult 52 to provide support for an infant 50 being held by the adult 52.

What is claimed is:

1. An infant support pillow comprising interconnected curved arms terminating in rounded ends which are spaced apart from each other to form a generally horseshoe-shaped member, the curved arms having an inner curved boundary constituting an inner circular opening and an outer concentric curved periphery having a series of peripheral recessed portions thereon, the pillow being provided with a fabric body wrap consisting of a T-shaped belt having a fabric leg and two fabric straps extending outwardly at right angles to the fabric leg, the fabric leg having an end attached centrally along the inner curved boundary and a second end connected to the two fabric straps, the fabric leg extending longitudinally from the inner curved boundary to the fabric straps, the fabric straps extending transversely across the pillow, the fabric leg of the T-shaped belt having sufficient length to be received through the legs of an infant and the fabric straps having sufficient length to wrap around the arms of the pillow, the fabric straps having outer ends which are releaseably attached to the arms of the pillow, the pillow being of sufficient size and thickness to provide support for an infant, the central circular opening having a diameter sufficient to accommodate the body of the infant wherein the peripheral recessed portions on the outer curved boundary of the pillow provide various locations at which the fabric straps of the T-shaped fabric belt may wrap around the pillow, thereby allowing for adjustment of the T-shaped belt with respect to the pillow opening, the recessed portions preventing the straps of the T-shaped belt from slipping down the arms of the support pillow when the fabric straps of the T-shaped belt and support pillow are affixed to the arms of the pillow.

2. An infant support pillow as set forth in claim 1 wherein the arms of the support pillow can be pulled inwardly or extended outwardly with relation to the central circular opening so as to contact the body of the infant in a number of variable positions and to allow for adjustment of the tightness of the body wrap around the body of the infant and wherein the arms of the support pillow are secured in a desired position by means of the transversely extending straps attaching at an underside thereof, causing the body of the infant to be elevated in a reclining position or permitting the body of the infant to sink into the central circular opening whereby the infant is held in a upright or sitting position.

3. An infant support pillow as set forth in claim 1 wherein an underside of each of the arms of the pillow is provided with an adhesive strip constituting one half of a hook and loop fastener and wherein the fabric straps of the T-shaped belt are provided, at each of their respective ends, with an adhesive tab constituting the other half of a hook and loop fastener whereby the tabs engage the strips to hold the T-shaped belt in place.

4. An infant support pillow as set forth in claim 3 wherein the adhesive strips extend longitudinally 6 to 8 inches and wherein the adhesive tabs extend transversely 5 to 7 inches such that the strips may engage the tabs in a number of variable positions.

5. An infant support pillow as set forth in claim 1 wherein the fabric leg of the T-shaped belt is provided with two sections of a hook and loop fastener, each having a length of about 3 to 5 inches, which hook and loop fastener is attached longitudinally along the fabric leg of the T-shaped belt whereby the length of the T-shaped belt may be adjusted by folding the leg of the T-shaped belt onto itself such that the hook and loop fasteners come into contact in a number of variable positions.

6. An infant support pillow as set forth in claim 1 wherein the central circular opening of the pillow is provided with a pocket such that the fabric T-shaped belt may be folded and inserted into the pocket when the T-shaped belt is not in use.

* * * * *